US007782265B1

(12) United States Patent
Horner et al.

(10) Patent No.: US 7,782,265 B1
(45) **Date of Patent: *Aug. 24, 2010**

(54) VARIABLE ASPECT RATIO TAPERED SLOT ANTENNA FOR EXTENDED LOW FREQUENCY RESPONSE

(75) Inventors: Rob Horner, San Diego, CA (US); Rod Cozad, San Diego, CA (US); Hale Simonds, San Diego, CA (US); Robbi Mangra, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 702 days.

This patent is subject to a terminal disclaimer.

(21) Appl. No.: 11/726,196

(22) Filed: Mar. 8, 2007

(51) Int. Cl.
*H01Q 13/10* (2006.01)

(52) U.S. Cl. ..... 343/767; 343/770

(58) Field of Classification Search ..... 343/767, 343/770

See application file for complete search history.

(56) References Cited

U.S. PATENT DOCUMENTS

| | | | | |
|---|---|---|---|---|
| 6,043,785 | A * | 3/2000 | Marino | 343/767 |
| 6,317,094 | B1 * | 11/2001 | Wu et al. | 343/767 |
| 6,525,696 | B2 * | 2/2003 | Powell et al. | 343/770 |
| 7,009,572 | B1 * | 3/2006 | Homer et al. | 343/767 |
| 7,148,855 | B1 | 12/2006 | Horner et al. | |
| 7,692,596 | B1 * | 4/2010 | Horner et al. | 343/767 |
| 2003/0020668 | A1 * | 1/2003 | Peterson | 343/846 |

* cited by examiner

*Primary Examiner*—Shih-Chao Chen
(74) *Attorney, Agent, or Firm*—Kyle Eppele; Stephen E. Baldwin

(57) ABSTRACT

A Variable Aspect Ratio Tapered Slot Antenna For Extended Low Frequency Response (NC #98541). The apparatus includes a tapered slot antenna having a length and a height, and having an aspect ratio less than or equal to 1 to 2.16. The tapered slot antenna includes a first antenna element comprising conductive material and configured to receive and transmit RF signals; and a second antenna element comprising conductive material, operatively coupled to said first antenna element, configured to receive and transmit RF signals.

22 Claims, 3 Drawing Sheets

300

Front View (Note: FIGS 1A-1B are NOT drawn to scale)

Side View

Side View (Note: FIGS 2A-2B are NOT drawn to scale)

Front View

300

VARIABLE ASPECT RATIO TAPERED SLOT ANTENNA FOR EXTENDED LOW FREQUENCY RESPONSE

FEDERALLY SPONSORED RESEARCH AND DEVELOPMENT

This invention (Navy Case No. 98541) is assigned to the United States Government and is available for licensing for commercial purposes. Licensing and technical inquiries may be directed to the Office of Research and Technical Applications, Space and Naval Warfare Systems Center, San Diego, Code 2112, San Diego, Calif., 92152; voice (619) 553-2778; email T2@spawar.navy.mil. Reference Navy Case Number 98541.

CROSS-REFERENCE TO RELATED APPLICATIONS

This application is related to U.S. Pat. No. 7,009,572, issued on Mar. 7, 2006, entitled "Tapered Slot Antenna", by Rob Horner et al., Navy Case No. 96507, which is hereby incorporated by reference in its entirety herein for its teachings on antennas. This application is also related to U.S. Pat. No. 7,148,855, issued on Dec. 12, 2006, entitled "Concave Tapered Slot Antenna", by Rob Horner et al., Navy Case No. 96109, which is hereby incorporated by reference in its entirety herein for its teachings on antennas.

BACKGROUND OF THE INVENTION

The present invention is generally in the field of antennas.

Typical tapered slot antennas have an average low frequency response. FIG. 1A is a side view of a typical tapered slot antenna (TSA). As shown in FIG. 1A, TSA 100 includes an antenna pair (i.e., antenna element 110 and antenna element 120) comprising conductive material. The antenna pair of TSA 100 has gap height 194, a feed end and a launch end. The feed end of the antenna pair corresponds to the portion of the antenna pair that is proximate to axis 140 (represented by dashed line K-K on FIG. 1A). The feed end receives and transmits signals. The launch end of the antenna pair corresponds to the portion of the antenna pair that is proximate to axis 146 (represented by dashed line N-N on FIG. 1A). Note that the launch end only denotes a location on the antenna pair versus an actual launch point of a particular frequency. Antenna element (AE) 110 has lateral edge 114, which corresponds to the portion of AE 110 that is proximate to axis 142 (represented by dashed line L-L on FIG. 1A). Antenna element 120 has lateral edge 124, which corresponds to the portion of AE 120 that is proximate to axis 144 (represented by dashed line M-M on FIG. 1A).

Typical TSA have an aspect ratio (i.e., length to height ratio) that is equal to 1. TSA length 154 of TSA 100 is defined as the distance between the feed end (proximate to axis 140) and the launch end (proximate to axis 146). TSA height 162 of TSA 100 is defined as the distance between the lateral edges of the antenna pair (i.e., the distance between lateral edge 114 and lateral edge 124) (i.e., the distance between axis 142 and axis 144). Thus, the aspect ratio of TSA 100 (i.e., ratio between TSA length 154 and TSA height 162) is equal to 1.

FIG. 1B is a front view of one embodiment of a typical TSA. TSA 100 of FIG. 1B is substantially similar to TSA 100 of FIG. 1A, and thus, similar components are not described again in detail herein below. As shown in FIG. 1B, TSA 100 includes an antenna pair (i.e., antenna element 110, antenna element 120). The antenna pair of TSA 100 has gap height 194. TSA 100 has TSA width 172.

A need exists for tapered slot antennas having extended low frequency response.

DETAILED DESCRIPTION OF THE INVENTION

The present invention is directed to Variable Aspect Ratio Tapered Slot Antenna For Extended Low Frequency Response.

DEFINITIONS

The following acronyms and definitions are used herein:

Acronym(s):

I/O—Input/Output

RF—radio frequency

TSA—Tapered Slot Antenna

VAR—Variable Aspect Ratio

Definition(s):

Aspect ratio—the ratio between the length and height of a TSA

The variable aspect ratio (VAR) tapered slot antenna for extended low frequency response includes a TSA having an aspect ratio less than or equal to 1 to 2.16 (i.e., approximately 0.462963). The VAR TSA for extended low frequency response includes an antenna pair.

Figure 1B:
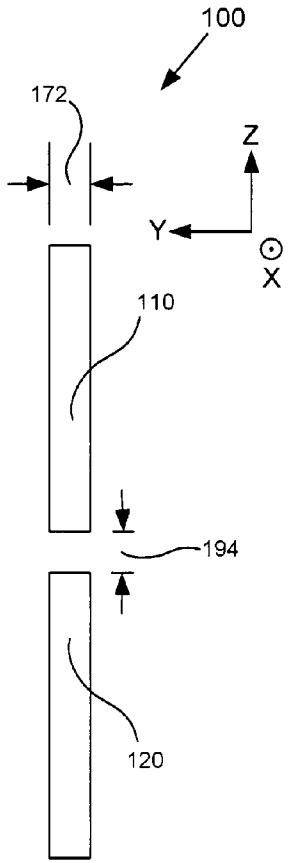
FIG. 1B (PRIOR ART)
FIG. 1B is a front view of a typical tapered slot antenna (PRIOR ART).
Figure 1A:
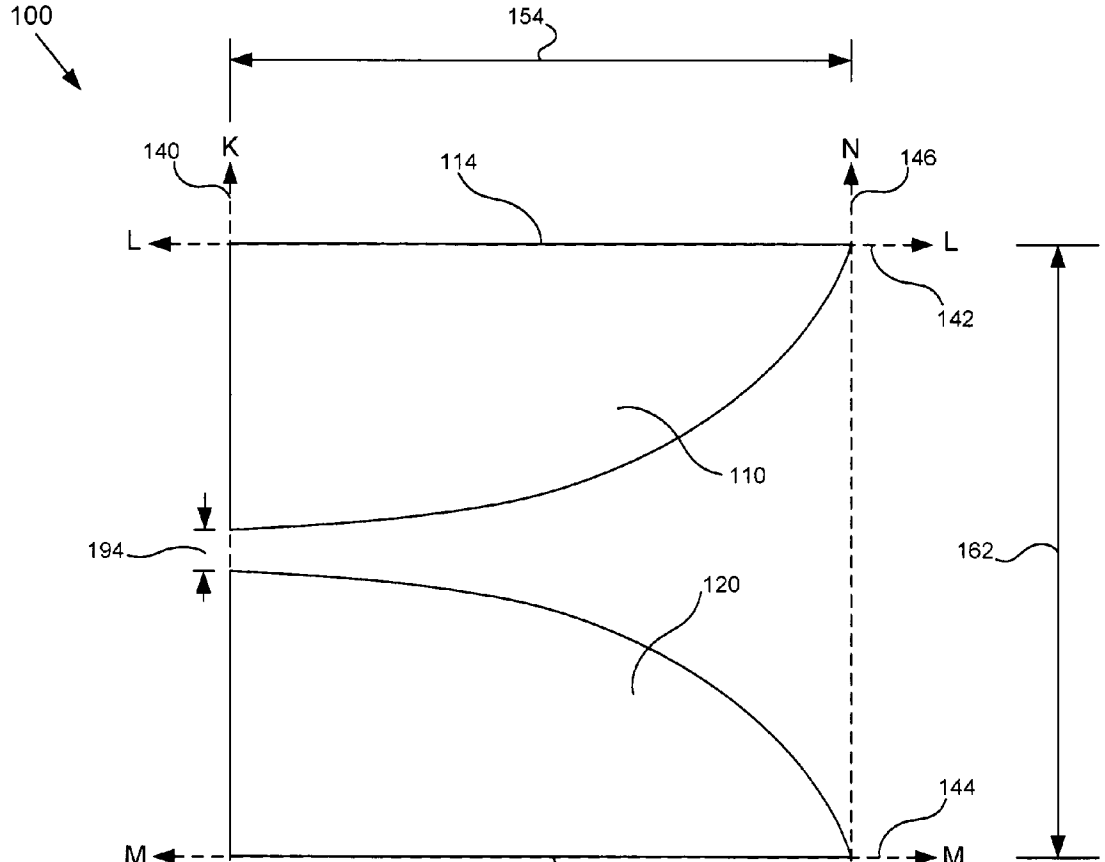
FIG. 1A (PRIOR ART)
FIG. 1A is a side view of a typical tapered slot antenna (PRIOR ART).
Figure 2A:
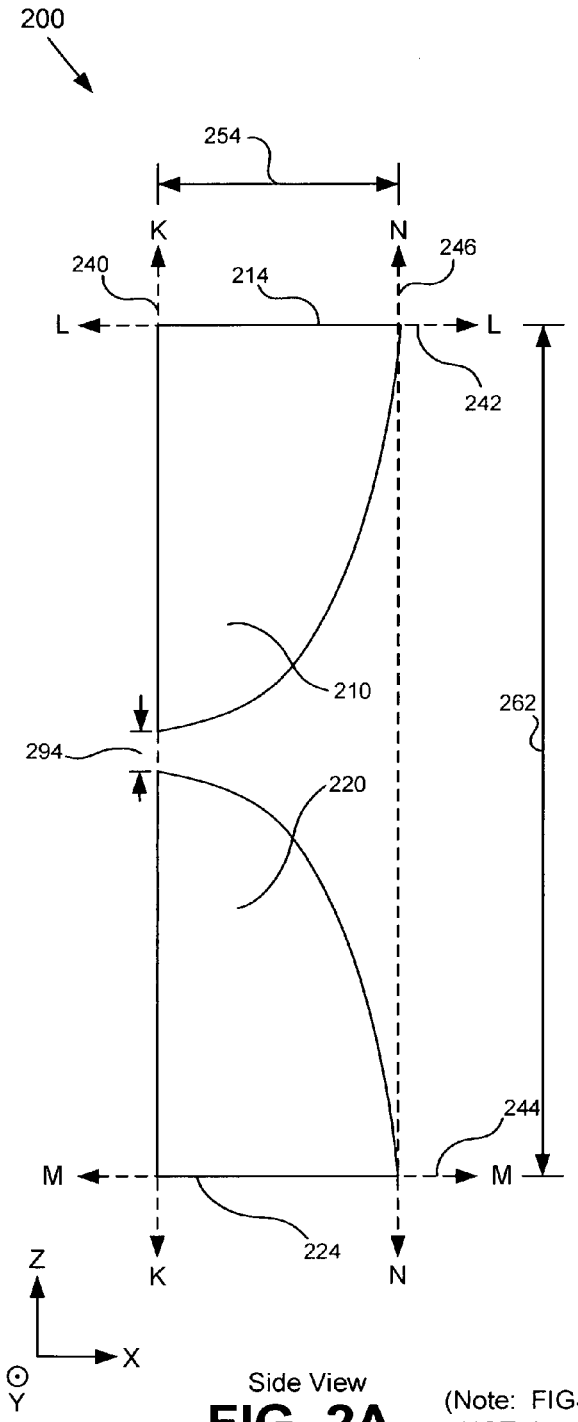
FIG. 2A is a side view of one embodiment of a variable aspect ratio tapered slot antenna.

FIG. 2A is a side view of one embodiment of a variable aspect ratio tapered slot antenna for extended low frequency response. As shown in FIG. 2A, VAR TSA for extended low frequency response 200 includes an antenna pair (i.e., antenna element 210 and antenna element 220) comprising conductive material. The antenna pair of VAR TSA for extended low frequency response 200 has gap height 294, a feed end and a launch end. The feed end of the antenna pair corresponds to the portion of the antenna pair that is proximate to axis 240 (represented by dashed line K-K on FIG. 2A). The feed end receives and transmits signals. The launch end of the antenna pair corresponds to the portion of the antenna pair that is proximate to axis 246 (represented by dashed line N-N on FIG. 2A). Note that the launch end only denotes a location on the antenna pair versus an actual launch point of a particular frequency. The feed end can be operatively coupled to an input/output (I/O) feed such as a coaxial cable. An I/O feed can be used to transmit and receive RF signals to and from VAR TSA for extended low frequency response 200. RF signals can be transmitted from the feed end toward the launch end, wherein the RF signals launch from the antenna pair at a point between the feed end and the launch end depending on the signal frequency. Antenna element 210 has lateral edge 214, which corresponds to the portion of AE 210 that is proximate to axis 242 (represented by dashed line L-L on FIG. 2A). Antenna element 220 has lateral edge 224, which corresponds to the portion of AE 220 that is proximate to axis 244 (represented by dashed line M-M on FIG. 2A).

In one embodiment, TSA antenna elements 210, 220 have curvatures that can each be represented by the following Equation 1:

$$Y(x)=a(e^{bx}-1) \quad \text{(Equation 1);}$$

where, a and b are parameters selected to produce a desired curvature.

In one embodiment, parameters "a" and "b" are approximately equal to 0.2801 and 0.1028, respectively.

VAR TSA for extended low frequency response 200 has an aspect ratio (i.e., length to height ratio) that is less than or equal to 1 to 2.16 (i.e., approximately 0.462963). In one embodiment, VAR TSA for extended low frequency response 200 has an aspect ratio less than or equal to 1 to 2.5. In one embodiment, VAR TSA for extended low frequency response 200 has an aspect ratio less than or equal to 1 to 3. In one embodiment, VAR TSA for extended low frequency response 200 has an aspect ratio less than or equal to 1 to 3.5. In one embodiment, VAR TSA for extended low frequency response 200 has an aspect ratio less than or equal to 1 to 4. In one embodiment, VAR TSA for extended low frequency response 200 has an aspect ratio less than or equal to 1 to 4.5. In one embodiment, VAR TSA for extended low frequency response 200 has an aspect ratio less than or equal to 1 to 5. In one embodiment, VAR TSA for extended low frequency response 200 has an aspect ratio less than or equal to 1 to 5.5. In one embodiment, VAR TSA for extended low frequency response 200 has an aspect ratio less than or equal to 1 to 6. In one embodiment, VAR TSA for extended low frequency response 200 has an aspect ratio less than or equal to 1 to 6.5. In one embodiment, VAR TSA for extended low frequency response 200 has an aspect ratio less than or equal to 1 to 7. In one embodiment, VAR TSA for extended low frequency response 200 has an aspect ratio less than or equal to 1 to 7.5. In one embodiment, VAR TSA for extended low frequency response 200 has an aspect ratio less than or equal to 1 to 8. In one embodiment, VAR TSA for extended low frequency response 200 has an aspect ratio less than or equal to 1 to 8.5. In one embodiment, VAR TSA for extended low frequency response 200 has an aspect ratio less than or equal to 1 to 9. In one embodiment, VAR TSA for extended low frequency response 200 has an aspect ratio less than or equal to 1 to 9.5. In one embodiment, VAR TSA for extended low frequency response 200 has an aspect ratio less than or equal to 1 to 10. In one embodiment, VAR TSA for extended low frequency response 200 has an aspect ratio less than or equal to 1 to 10.5. In one embodiment, VAR TSA for extended low frequency response 200 has an aspect ratio less than or equal to 1 to 11. In one embodiment, VAR TSA for extended low frequency response 200 has an aspect ratio less than or equal to 1 to 11.5. In one embodiment, VAR TSA for extended low frequency response 200 has an aspect ratio less than or equal to 1 to 12. TSA length 254 of VAR TSA for extended low frequency response 200 is defined as the distance between the feed end (proximate to axis 240) and the launch end (proximate to axis 246). TSA height 262 of VAR TSA for extended low frequency response 200 is defined as the distance between the lateral edges of the antenna pair (i.e., the distance between lateral edge 214 and lateral edge 224) (i.e., the distance between axis 242 and axis 244). Thus, the aspect ratio of VAR TSA for extended low frequency response 200 (i.e., ratio between TSA length 254 and TSA height 262) is less than or equal to 1 to 2.16. In one embodiment, TSA length 254 equals 1 foot and TSA height equals 2.16 feet. In one embodiment, TSA length 254 equals 2 feet and TSA height equals 4.32 feet.

Figure 2B:
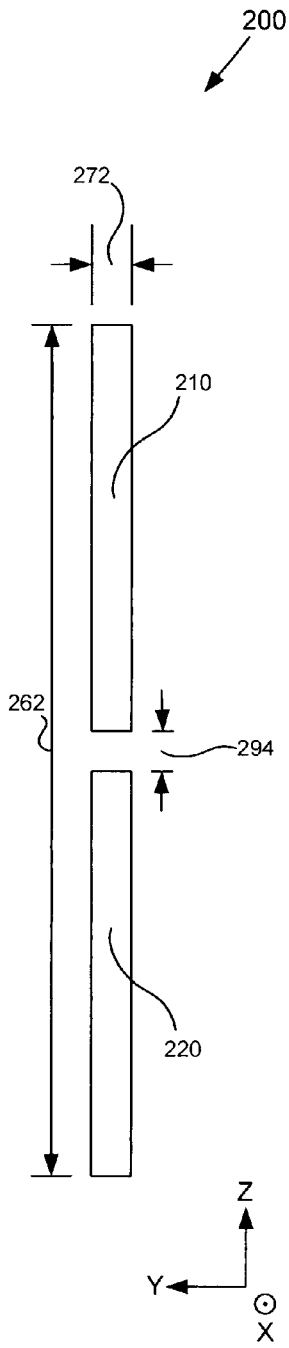
FIG. 2B is a front view of one embodiment of a variable aspect ratio tapered slot antenna.

FIG. 2B is a front view of one embodiment of a VAR TSA for extended low frequency response. VAR TSA for extended low frequency response 200 of FIG. 2B is substantially similar to VAR TSA for extended low frequency response 200 of FIG. 2A, and thus, similar components are not described again in detail hereinbelow. As shown in FIG. 2B, VAR TSA for extended low frequency response 200 includes an antenna pair (i.e., antenna element 210, antenna element 220). The antenna pair of VAR TSA for extended low frequency response 200 has gap height 294. VAR TSA for extended low frequency response 200 has TSA width 272.

Figure 3:
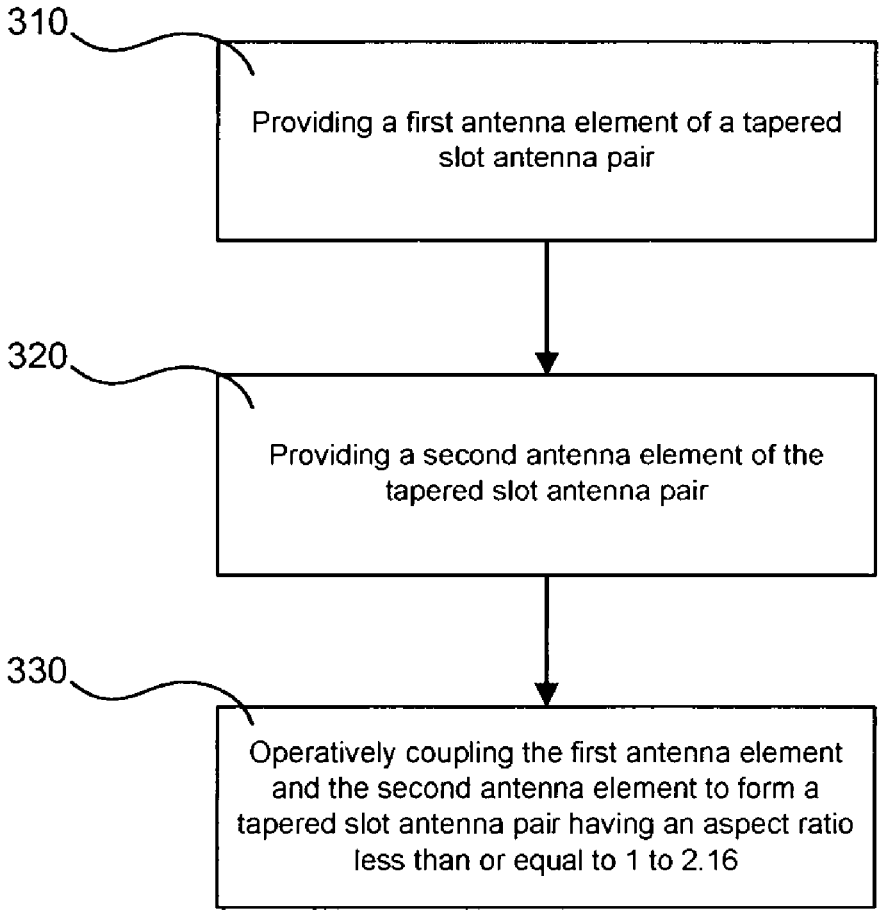
FIG. 3 is a flowchart of an exemplary method of manufacturing one embodiment of a variable aspect ratio tapered slot antenna.

FIG. 3 is a flowchart illustrating an exemplary process to implement an exemplary VAR TSA for extended low frequency response. While boxes 310 through 330 shown in flowchart 300 are sufficient to describe one embodiment of an exemplary TSACA, other embodiments of the TSACA may utilize procedures different from those shown in flowchart 300.

We claim:

1. An apparatus, comprising:

a tapered slot antenna forming a slot and having an antenna length and an antenna height, and having an aspect ratio less than or equal to 1 to 2.16, comprising:

a first antenna element comprising conductive material, configured to receive and transmit RF signals;

a second, separate antenna element comprising conductive material, operatively coupled to said first antenna element, configured to receive and transmit RF signals, where the first and second antenna elements are spaced apart from one another by at least a gap height to form the tapered slot antenna, each antenna element having an exponentially tapered curvature forming the slot and where the antenna height of the antenna elements can be varied while maintaining the aspect ratio for extended low frequency response.

2. The apparatus of claim 1, wherein said length equals 1 foot and said height equals 2.16 feet.

3. The apparatus of claim 1, wherein said length equals 2 feet and said height equals 4.32 feet.

4. The apparatus of claim 1, wherein said aspect ratio is less than or equal to 1 to 2.5.

5. The apparatus of claim 1, wherein said aspect ratio is less than or equal to 1 to 3.

6. The apparatus of claim 1, wherein said aspect ratio is less than or equal to 1 to 3.5.

7. The apparatus of claim 1, wherein said aspect ratio is less than or equal to 1 to 4.

8. The apparatus of claim 1, wherein said aspect ratio is less than or equal to 1 to 4.5.

9. The apparatus of claim 1, wherein said aspect ratio is less than or equal to 1 to 5.

10. The apparatus of claim 1, wherein said aspect ratio is less than or equal to 1 to 5.5.

11. The apparatus of claim 1, wherein said aspect ratio is less than or equal to 1 to 6.

12. The apparatus of claim 1, wherein said aspect ratio is less than or equal to 1 to 6.5.

13. The apparatus of claim 1, wherein said aspect ratio is less than or equal to 1 to 7.

14. The apparatus of claim 1, wherein said aspect ratio is less than or equal to 1 to 7.5.

15. The apparatus of claim 1, wherein said aspect ratio is less than or equal to 1 to 8.

16. The apparatus of claim 1, wherein said aspect ratio is less than or equal to 1 to 9.

17. The apparatus of claim 1, wherein said aspect ratio is less than or equal to 1 to 10.

18. The apparatus of claim 1, wherein said aspect ratio is less than or equal to 1 to 11.

19. The apparatus of claim 1, wherein said aspect ratio is less than or equal to 1 to 12.

20. The apparatus of claim 1, wherein the exponentially tapered curvatures are represented by the equation $Y(x)=a(e^{bx}-1)$, wherein, a and b are parameters selected to produce a desired curvature, x is the length of the antenna and Y is the height of the antenna.

21. An apparatus, comprising:

a tapered slot antenna forming a slot and having an antenna length and an antenna height, and having an aspect ratio less than or equal to 1 to 2.16, comprising:

a first antenna element comprising conductive material, configured to receive and transmit RF signals;

a second, separate antenna element comprising conductive material, operatively coupled to said first antenna element, configured to receive and transmit RF signals, where the first and second antenna elements each have respective input edges, lateral edges and curvature edges and where the first and second antenna elements including the respective edges are spaced apart from one another by at least a gap height to form the tapered slot antenna, each antenna element curvature edge having an exponentially tapered curvature forming the slot and where the antenna height of the antenna elements can be varied while maintaining the aspect ratio for extended low frequency response.

22. An apparatus, comprising:

a tapered slot antenna forming a slot and having an antenna length and an antenna height, and having an aspect ratio less than or equal to 1 to 2.16, comprising:

a first antenna element comprising conductive material, configured to receive and transmit RF signals;

a second, separate antenna element comprising conductive material, operatively coupled to said first antenna element, configured to receive and transmit RF signals, where the first and second antenna elements each have respective input edges, lateral edges and curvature edges and where the first and second antenna elements including the respective edges are spaced apart from one another by at least a gap height to form the tapered slot antenna, each antenna element curvature edge having an exponentially tapered curvature forming the slot and where the antenna height of the antenna elements can be varied while maintaining the aspect ratio for extended low frequency response and wherein the exponentially tapered curvatures are represented by the equation $Y(x)=a(e^{bx}-1)$, where a and b are parameters selected to produce a desired curvature, x is the length of the antenna and Y is the height of the antenna.

* * * * *